US005878974A

United States Patent [19]

Schumacher et al.

[11] Patent Number: 5,878,974

[45] Date of Patent: Mar. 9, 1999

[54] DEVICE FOR WINDING A TEXTILE WEB

[75] Inventors: Walter Schumacher, Aachen; Wolfgang Kurschatke, Krefeld, both of Germany

[73] Assignee: Eduard Kusters Maschinefabrik GmbH & Co. KG, Krefeld, Germany

[21] Appl. No.: 177

[22] Filed: Jan. 23, 1998

[30] Foreign Application Priority Data

Jul. 25, 1995 [DE] Germany ..... 195 27 110.6

[51] Int. Cl.[6] ..... B65H 18/16; D06B 3/00; F26B 5/12; F26B 13/00

[52] U.S. Cl. ..... 242/541; 242/419.3; 34/414; 34/625; 68/180

[58] Field of Search ..... 242/419.3, 541, 242/541.4, 541.5, 541.6, 541.7, 547, 908; 68/180, 20; 15/309.1; 34/414, 462, 625

[56] References Cited

U.S. PATENT DOCUMENTS 4,858,843 8/1989 Gierse et al. ..... 242/541
4,906,333 3/1990 Myren ..... 15/309.1
5,028,011 7/1991 Schiffers ..... 242/541
5,791,165 8/1998 Von Harten et al. ..... 68/180

FOREIGN PATENT DOCUMENTS 0144818 6/1985 European Pat. Off. .
3239450 4/1984 Germany .

OTHER PUBLICATIONS

Vernazza, Cloth–Guiding Problems in Textile Finishing, Melliand Textile Reports, pp. 819–826, 1972.

*Primary Examiner*—John M. Jillions
*Attorney, Agent, or Firm*—Kenyon & Kenyon

[57] ABSTRACT

A device to wind and unwind a textile web onto and from a spool, when it comes into or out of a wet-processing group is disclosed. The device includes a guide and tension roll supported at the free ends of winding arms and resting on the spool. A moisture-extraction device in the form of a suction pipe is mounted immediately upstream of the guide and tension roll. The web may thus be wound onto the spool with a relatively low moisture content.

7 Claims, 1 Drawing Sheet

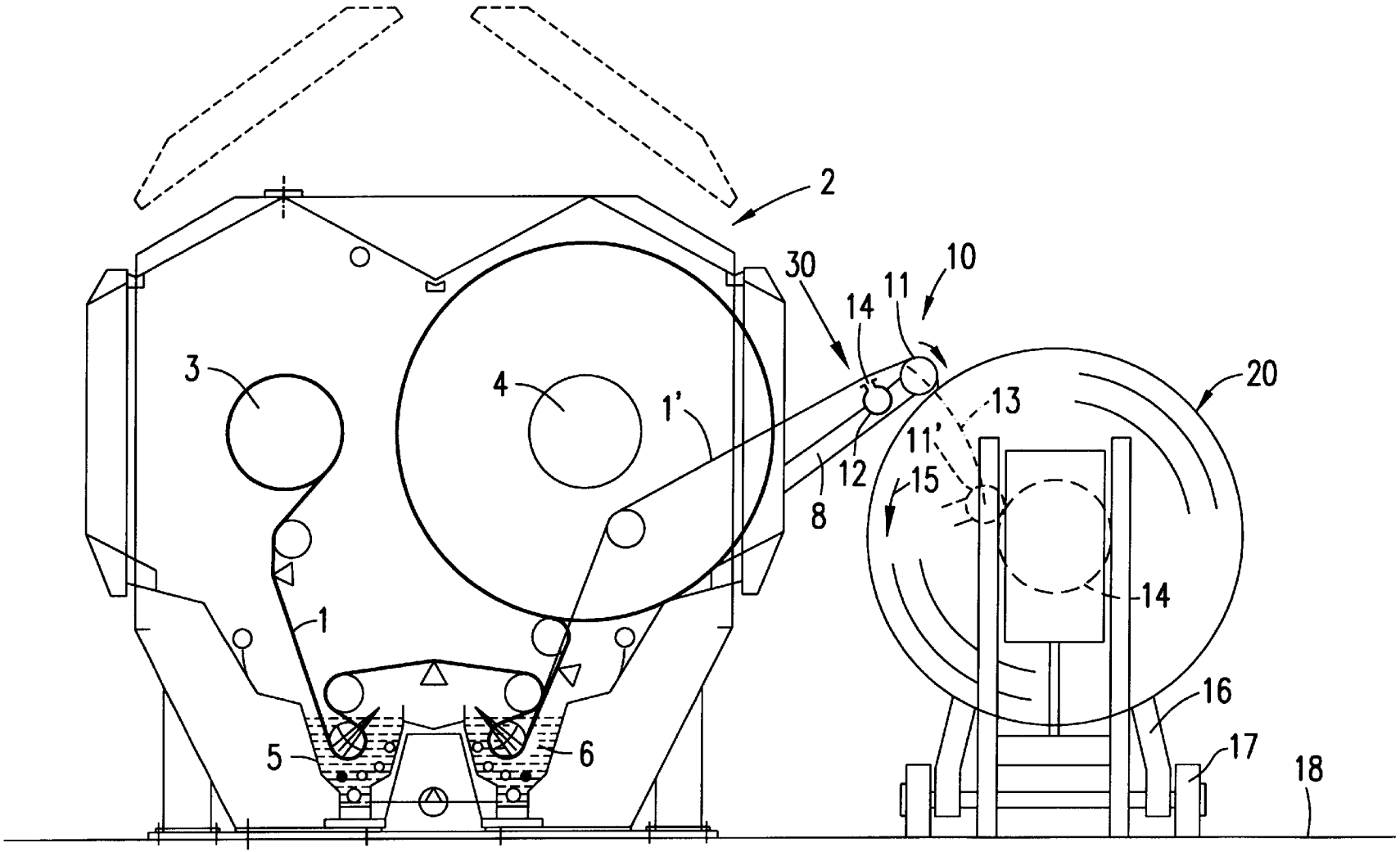
2
30
10
11
14
12
8
1'
4
3
1
5
6
13
11'
15
20
14
16
17
18

DEVICE FOR WINDING A TEXTILE WEB

FIELD OF THE INVENTION

The invention relates to devices for winding textile webs onto a spool, and more particularly to a device for removing moisture from the textile web before winding the web onto a spool.

BACKGROUND INFORMATION

Devices are known for winding a textile web coming from a wet treatment jig onto a spool. Devices for winding a textile web onto a spool may include, for example, a winding frame having a width greater than a width of the web and a spool carrier adjacent to the winding frame for supporting the spool on a spindle. Winding arms may be mounted by their first end on the winding frame on both sides of the web at the approximate height of the spool. The winding arms at their opposite or free ends may support a guide and tension roll so that it rests on the spool approximately parallel to the spindle of the spool. The web loops from a top side of the guide and tension roll around a side of the guide and tension roll facing away from the winding frame and winds onto a top side of the spool, toward the winding frame.

German patent 32 39 450 A1, incorporated herein by reference for these teachings, discloses a device for winding a textile web onto a spool which does not operate with a guide and tension roll mounted on swivelling winding arms and resting on the spool. Rather, the device of German patent 32 39 450 A1 comprises a suction/roll-out fabric spreader arranged a short distance before the wind-up of the web onto the spool. The suction/roll-out fabric spreader is partially looped by the web. Provided in the looping area is a suction slit through which moisture in the web can be suctioned off. It is known from German patent 36 05 994 A1 to arrange a suction slit, extending transversely over the web, in the region of the entrance of a web in a tenter drier.

German patent 35 46 414 A1, incorporated herein by reference for these teachings, concerns the adjustment of uniform applications of treatment agents on running webs such as textile webs and paper webs, the webs being subjected, after the treatment-agent application, to a controlled and regulated suction operation for excess quantities of treatment agent.

A device for winding wet-treated textile webs is known from the article of Vernazza "Warenführungsprobleme in der Textilveredlung" [translated "Cloth-Guiding Problems in Textile Finishing"] in Melliand Textilberichte [Melliand Textile Reports] (1972), pages 819 to 826, which is incorporated herein by reference for these teachings, and particularly page 823, illustration 37, and from the European patent 144 818 A1, which is incorporated herein by reference for these teachings. The wet treatment is usually a washing operation, followed by squeezing in a squeezing apparatus, after which the winding operation is carried out with the known winding mechanism. However, it can also be a wet treatment in a jig. The spool carrier is usually a customary spool carriage upon which the spool can be transported in the shop. The winder can be a center wind in which the spool spindle is driven, or a surface-driven winder in which the tension roll is driven, which drives the spool at its periphery at the same time.

One object of the invention is to reduce the equipment expenditure of such a device. This object is achieved by adapting a known winding device as described above with a suction device arranged at the free ends of the winding arms a short distance before the guide and tension roll as viewed in a direction of travel of web. The suction device includes a suction slit which extends over the width of the web.

Due to the moisture extraction of the suction device, the otherwise necessary squeezing apparatus, which includes at least two rolls, as well as the usually necessary compensator, may be eliminated. The web can be reeled and let stand without water pockets forming and without having to constantly turn the spool in order to avoid the formation of water packets.

The suction device is expediently mounted in the space under the web at the winding arms.

BRIEF DESCRIPTION OF THE DRAWING

FIG. 1 depicts an embodiment of the invention constructed according to the principles of the invention, shown schematically in a vertical, longitudinal cross-section.

DETAILED DESCRIPTION OF THE INVENTION

Web 1 passes, in opened-out form, through a jig 2 having left and right lap rolls 3 and 4, respectively, supported in a frame 7. The web 1 may be wound back and forth several times about the rolls 3 and 4 during the operation of jig 2, as indicated by the thick lines. During such operation, the web 1 passes through reservoirs 5 and 6, which contain treatment liquids. After the necessary number of passings, the web 1 is unrolled at jig 2 and, in so doing, takes course 1' shown in thin lines. In the state shown in FIG. 1, web 1 has been unrolled from the left lap roll 3 onto spool 20 which stands to the right of the jig 2.

A lapping and unlapping device, designated generally by reference numeral 10, is used to transfer the web 1 from the jig 2 to the spool 20. The lapping and unlapping device 10 comprises winding arms 8 that run laterally outside of web 1, roughly parallel to the web edges. The winding arms 8 may be supported on their first ends on jig 2 such that the winding arms 8 may tilt up and down. The winding arms 8 have a length which, in the exemplary embodiment, corresponds to the diameter of the ready spool 20. Supported at the free end of winding arms 8 is a guide and tension roll 11 which abuts upon spool 20 under its own weight and the weight of winding arms 8 and, in the exemplary embodiment, is driven in the direction indicated by arrow 19. Thus, the device is a surface-driven winder. The web 1 is guided via the upper side of a guide roll arranged in jig 2 and via the upper side of the guide and tension roll 11. The web 1 is conducted around the side of the guide and tension roll 11 facing away from jig 2, whereupon it mounts spool 20 at the lower side of the guide and tension roll 11 toward jig 2. The spool 20 is rotated in the direction of arrow 15, as shown in FIG. 1.

The guide and tension roll 11 can be tilted up and down on the winding arms 8 such that the axis of the guide and tension roll 11 may cover a path indicated by circular arc 13. In the lowest position 11', in which the winding arms 8 extend rather flatly, the guide and tension roll 11 rests on spindle 21 of the spool 20. The winding of the web 1 about the spool 20 begins in position 11' and extends outward on the circular arc 13 until the spool reaches approximately the maximum size shown in the drawing. The spindle 21 of the spool 20 is supported on a spool carriage 16 that may be moved on wheels 17 on a shop floor 18.

A moisture-extraction device 30 is provided on the winding arms 8 near and upstream of the guide and tension roll 11. The moisture-extraction device 30 may be in the form of a suction pipe 12 that extends transversely over the width of the web 1 and has a suction slit 14. The suction pipe 12 is mounted below the web 1, which is guided at a slight looping angle over the suction slit 14, so that the web 1 is always automatically held in contact on suction slit 14.

The suction pipe 12 extracts moisture from web 1, which may have experienced a last saturation with a treatment liquid in reservoir 6. Thus, the web 1 is reeled onto spool 20 with a relatively low moisture content.

What is claimed is:

1. A device for winding a textile web coming from a wet treatment onto a spool, the device comprising:

a winding frame having a width greater than a width of the web;

a spool carrier adjacent to the winding frame for supporting the spool on a spindle;

winding arms having first and second ends, the first ends being supported on the winding frame on both sides of the web at a height of the spool;

a guide and tension roll resting on the spool which is supported on a second end of the winding arms, the guide and tension roll being arranged parallel to the spindle of the spool and above the spool, wherein the web loops from a top side of the guide and tension roll around a side of the guide and tension roll facing away from the winding frame and winds onto a top side of the spool, toward the winding frame; and a suction device having a suction slit extending over the width of the web, the suction device arranged at the second ends of the winding arms a short distance before the guide and tension roll as viewed in a direction of travel of the web.

2. The device according to claim 1 wherein the suction device is arranged below the web.

3. A device for winding a textile web onto a spool after wet treatment by a processing jig, the device comprising:

a spool carrier disposed adjacent to the jig for supporting the spool on a spindle;

a winding arm having a first and a second end, the first end being pivotably supported on the processing jig at a height approximately equal to a height of the spool;

a guide and tension roll disposed substantially parallel to the spindle and above the spool, the guide and tension roll being supported on the second end of the winding arm such that the guide and tension roll rests on the spool, wherein the web passes at least partially around the guide and tension roll and onto the spool; and a suction device having a suction slit extending over the width of the web, the suction device arranged at the second end of the winding arm before the guide and tension roll as viewed in a direction of travel of the web.

4. The device according to claim 3 wherein the suction device is arranged below the web.

5. The device according to claim 3 wherein an axis of the guide and tension roll is disposed above a center of the spindle such that the weight of the guide and tension roll causes the guide and tension roll to abut against the spool.

6. The device according to claim 3 wherein the guide and tension roll is driven.

7. The device according to claim 3 wherein the suction device is disposed in a path of the web such that the web traverses over the suction device, the path of the web ensuring contact of the web with the suction device.

* * * * *

UNITED STATES PATENT AND TRADEMARK OFFICE

CERTIFICATE OF CORRECTION

PATENT No. : 5,878,974

DATED : March 9, 1999

INVENTOR(S): Walter Schumacher and Wolfgang Kurschatke

It is certified that error appears in the above-identified patent and that said Letters Patent is hereby corrected as shown below:

On the title page: item [21], Appl. No. should read - - 09/000,177 - -.

Signed and Sealed this

Seventh Day of December, 1999

*Attest:*

*Attesting Officer*

Q. TODD DICKINSON

*Acting Commissioner of Patents and Trademarks*